US007992866B2

(12) United States Patent
Müller et al.

(10) Patent No.: US 7,992,866 B2
(45) Date of Patent: Aug. 9, 2011

(54) APPARATUS FOR ALIGNING SHEETS ON STOPS

(75) Inventors: Andreas Müller, Heidelberg (DE); Georg Grasmück, Deidesheim (DE); Burkhard Wolf, Dossenheim (DE); Jochen Renner, Edingen-Neckarhausen (DE); Leva Markus, Darmstadt (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 136 days.

(21) Appl. No.: 12/405,392

(22) Filed: Mar. 17, 2009

(65) Prior Publication Data

US 2009/0230609 A1 Sep. 17, 2009

(30) Foreign Application Priority Data

Mar. 17, 2008 (DE) ..... 10 2008 014 593

(51) Int. Cl.
*B65H 9/04* (2006.01)

(52) U.S. Cl. ..... 271/243; 271/244; 271/247; 271/237; 271/235

(58) Field of Classification Search ..... 271/243–247, 271/235, 237

See application file for complete search history.

(56) References Cited

U.S. PATENT DOCUMENTS

| | | | | |
|---|---|---|---|---|
| 4,330,117 | A * | 5/1982 | Weisbach | 271/235 |
| 5,080,347 | A * | 1/1992 | Funada | 271/266 |
| 5,297,789 | A * | 3/1994 | Filsinger et al. | 271/245 |
| 5,301,938 | A * | 4/1994 | Casper | 271/245 |
| 5,390,908 | A * | 2/1995 | Luxem | 271/247 |
| 5,496,023 | A * | 3/1996 | Becker et al. | 271/245 |
| 5,761,998 | A | 6/1998 | Fricke et al. | |
| 5,947,469 | A * | 9/1999 | Henn et al. | 271/228 |
| 6,241,241 | B1 * | 6/2001 | Fricke et al. | 271/245 |
| 6,921,070 | B2 * | 7/2005 | Berti et al. | 271/264 |
| 2009/0250869 | A1 * | 10/2009 | Muller et al. | 271/245 |

FOREIGN PATENT DOCUMENTS

| | | | |
|---|---|---|---|
| DE | 874453 | C | 4/1953 |
| DE | 3830260 | A1 | 3/1990 |
| DE | 19600793 | C2 | 7/1997 |
| DE | 102005049401 | A1 | 5/2007 |
| EP | 1757543 | A2 | 2/2007 |
| GB | 1326891 | A | 8/1973 |

OTHER PUBLICATIONS

German Search Report dated Oct. 22, 2008.

* cited by examiner

*Primary Examiner* — Stefanos Karmis
*Assistant Examiner* — Luis A Gonzalez
(74) *Attorney, Agent, or Firm* — Laurence A. Greenberg; Werner H. Stemer; Ralph E. Locher

(57) ABSTRACT

An apparatus for aligning sheets in a processing machine includes translationally movable stops or front lays which can be driven through the use of a coupler mechanism or individually actuable electric motors.

10 Claims, 4 Drawing Sheets

APPARATUS FOR ALIGNING SHEETS ON STOPS

CROSS-REFERENCE TO RELATED APPLICATION

This application claims the priority, under 35 U.S.C. §119, of German Patent Application DE 10 2008 014 593.9, filed Mar. 17, 2008; the prior application is herewith incorporated by reference in its entirety.

BACKGROUND OF THE INVENTION

Field of the Invention

The invention relates to an apparatus for aligning sheets which are fed to a processing machine, in particular a printing press.

For example, it is known from German Patent DE 196 00 793 C2, corresponding to U.S. Pat. No. 5,761,998, to align sheets at the end of a feed table on stops in the sheet transport direction, so-called front lays. After sheet alignment has been carried out on the feed table, the stops are moved out of an aligning position through the use of a stop shaft about a fixed rotational point, into a pivoted away position which is provided below a sheet transport plane.

SUMMARY OF THE INVENTION

It is accordingly an object of the invention to provide an apparatus for aligning sheets on stops, which overcomes the hereinafore-mentioned disadvantages of the heretofore-known devices of this general type and in which the sheet is aligned while in motion in a sheet transport direction.

With the foregoing and other objects in view there is provided, in accordance with the invention, in a processing machine, in particular a printing press, having a feed table and stops receiving sheets at a predefined speed at an end of the feed table, an apparatus for aligning the sheets on the stops. The apparatus comprises a cam mechanism for producing a translational movement of the stops.

It is one particular advantage of the invention that the stops are disposed in such a way that they can be moved translationally during the sheet alignment. As a result of this measure, the sheet does not need to be stopped for alignment. Consequently, higher feed speeds of the sheets to processing machines can be achieved.

A further advantage is the control of the movement of the stops through the use of a cam mechanism which is provided. As a result of this measure, the stops can be lowered below a sheet transport plane and can be moved back into an aligning position, as a consequence of which the stops do not obstruct the sheet to be transported while they are transported back.

The control cams of the cam mechanism can be driven through the use of a gearwheel train which also drives the processing machine. Moreover, it is advantageous if individually actuable motors are provided for driving the control cams.

In one particularly advantageous refinement, an actuating device, which can be actuated during operation, is provided individually for each stop.

Other features which are considered as characteristic for the invention are set forth in the appended claims.

Although the invention is illustrated and described herein as embodied in an apparatus for aligning sheets on stops, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
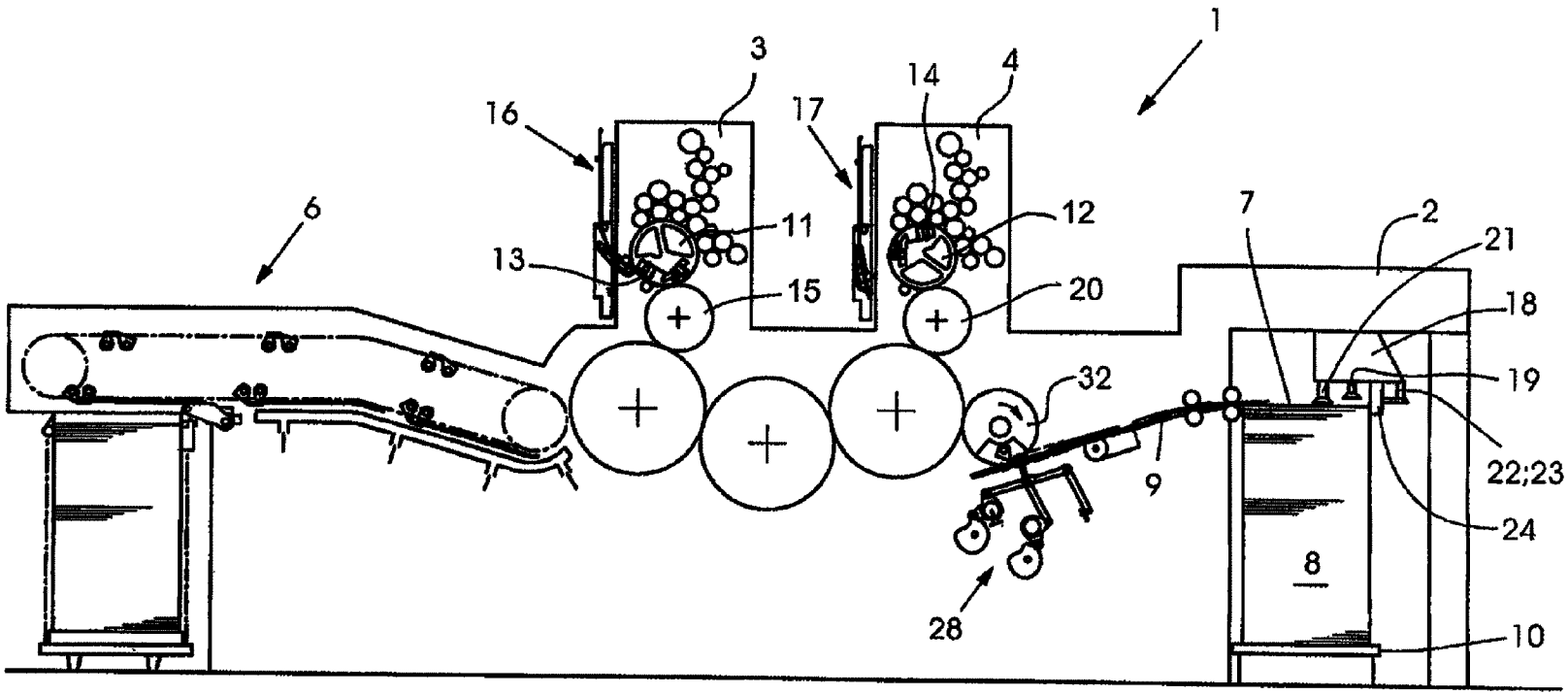
FIG. 1 is a diagrammatic, longitudinal-sectional view of a sheet-fed rotary printing press.

Referring now to the figures of the drawings in detail and first, particularly, to FIG. 1 thereof, there is seen a machine, for example a printing press 1, which processes sheets 7 and has a feeder 2, at least one printing unit 3 or 4 and a delivery 6. The sheets 7 are removed from a sheet stack 8 and fed individually or overlapped over a feed table 9 to the printing units 3 and 4. The printing units 3 and 4 each include, in a known manner, plate cylinders 11, 12 and blanket cylinders 15, 20 each of which interact with a respective one of the plate cylinders. The plate cylinders 11 and 12 in each case has a respective clamping and tensioning apparatus 13, 14 for fastening flexible printing plates. Moreover, each plate cylinder 11, 12 is assigned a respective apparatus 16, 17 for the semi-automatic or fully automatic change of printing plates.

The sheet stack 8 lies on a stack board 10 which can be raised in a controlled manner. The sheets 7 are removed from the upper side of the sheet stack 8 through the use of a so-called suction head 18 which has, inter alia, a number of lifting and dragging suckers 19, 21 for the separation of the sheets 7. Moreover, blowing devices 22 are provided for loosening the upper sheet layers and sensing elements 23 are provided for stack tracking. A number of lateral and rear stops 24 are provided for aligning the sheet stack 8, in particular the upper sheets 7 of the sheet stack 8.

Figure 2:
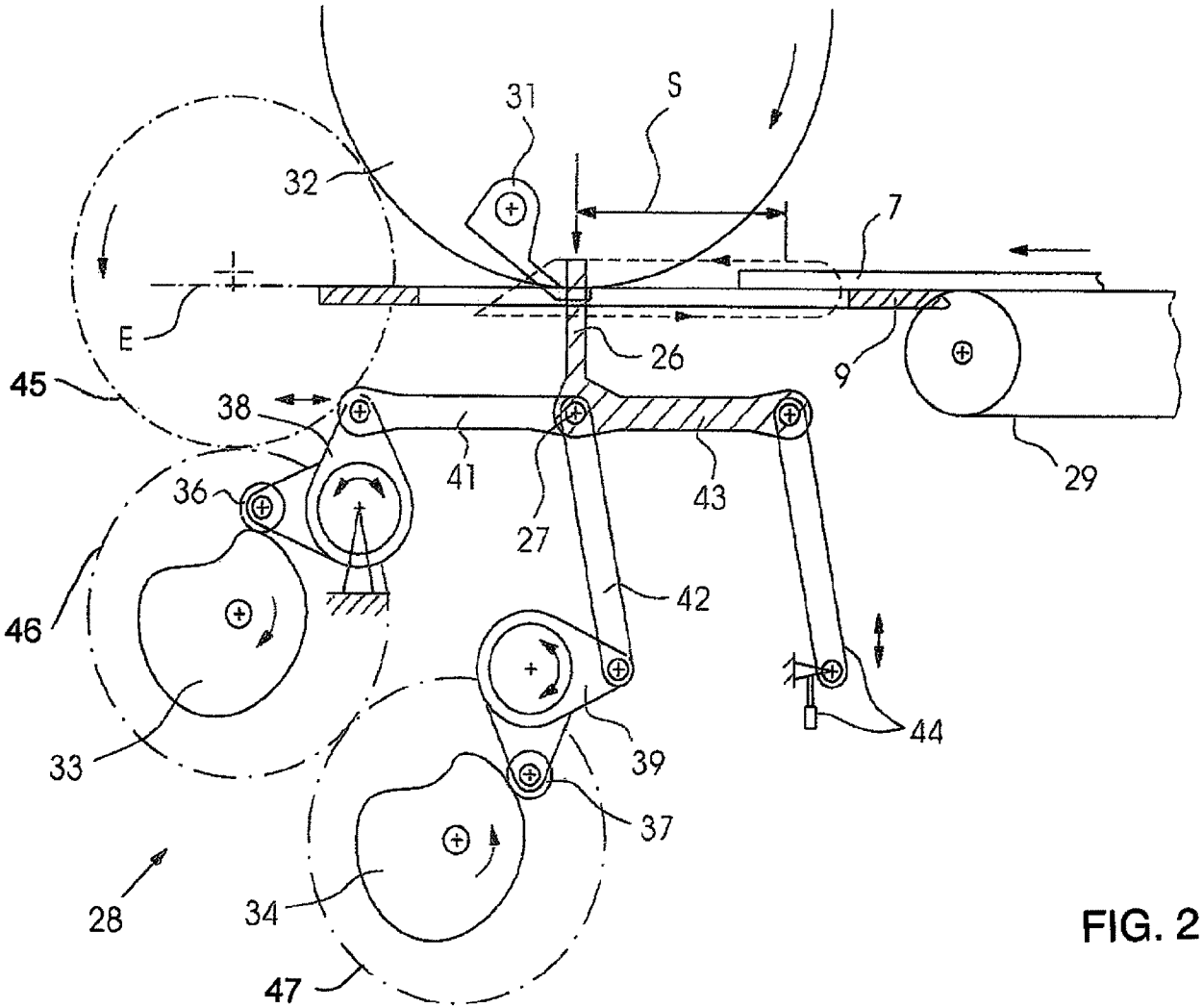
FIG. 2 is an enlarged, fragmentary, sectional view of a drive apparatus according to the invention for stops, using a gearwheel train of the sheet processing machine.

As is seen in FIG. 2, a number of stops or front lays 26 are disposed on a common stop shaft 27 at the end of the feed table 9, which are disposed transversely with respect to the sheet transport direction. A sheet 7 to be fed to the processing machine is conveyed to the stops 26 through the use of at least one transport belt 29, in particular a suction belt. The stops 26 are disposed in such a way that they can be moved translationally in the sheet transport direction through the use of a cam mechanism 28. The sheet 7 to be aligned comes into contact by way of its leading edge with the stops at a somewhat higher speed $V_1$ than the speed $V_2$ of the stops and is aligned in the sheet transport direction and the oblique position on a path S between the end of the feed table 9 and the acceptance of the sheets 7 by grippers 31 of a first cylinder 32, in particular a feed cylinder of the printing press. When the sheets 7 are accepted by the grippers 31 of the feed cylinder 32, the speed $V_2$ of the stops 26 is synchronized with a speed $V_3$ of the grippers 31.

The cam mechanism 28 is constructed for generating a translational movement of the stops 26 which extends in the sheet transport direction above the sheet transport plane E defined by the feed table 9, and a restoring movement of the stops 26 which extends below the plane E counter to the sheet transport direction.

The cam mechanism 28 has two control cams 33, 34 which are driven synchronously with the sheet processing machine 1 and are articulated on the stop shaft 27 in each case through the use of a respective control roller 36, 37, a respective lever 38, 39 and a respective coupler 41, 42.

Figure 2A:
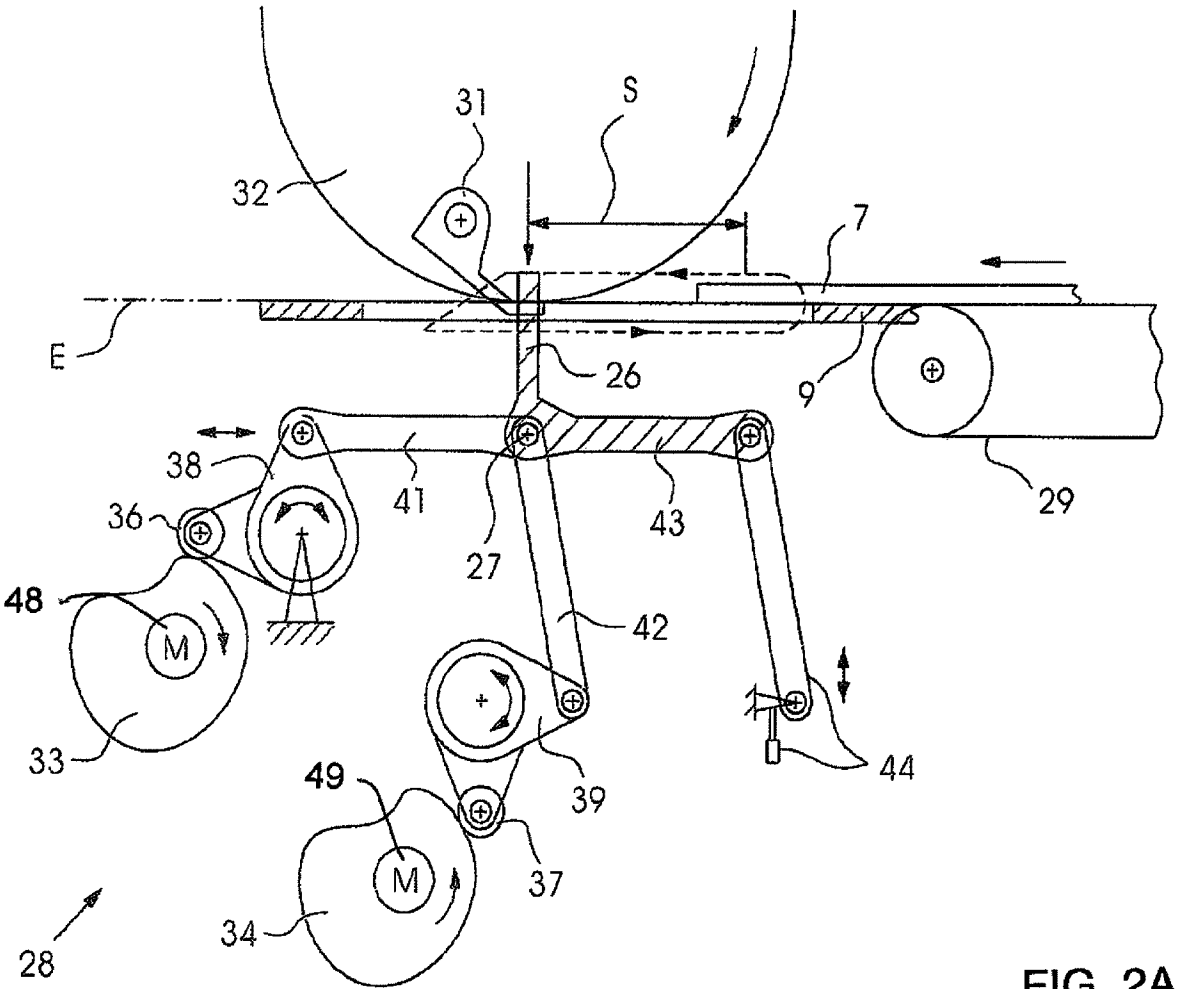
FIG. 2A is an enlarged, fragmentary, sectional view of a drive apparatus according to the invention for stops, using individually actuable electric motors.

The control cams 33, 34 are driven by a gearwheel train of the sheet processing machine having gearwheels 45, 46, 47 as shown in FIG. 2. It is particularly advantageous if individually actuable electric motors 48, 49 are provided to drive the control cams 33, 34 as shown in FIG. 2A. A speed profile of the stops 26 can be controlled by this measure.

Figure 3:
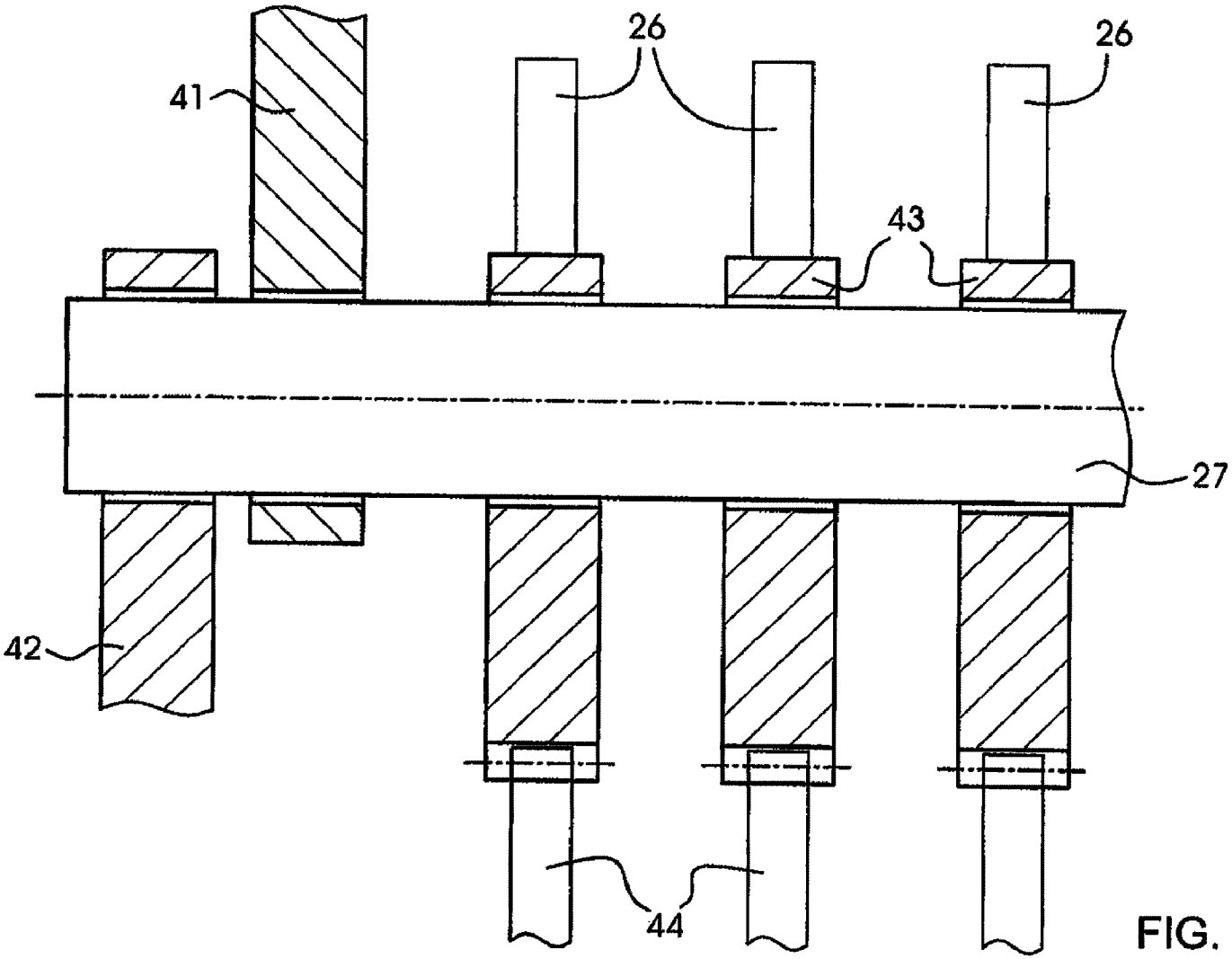
FIG. 3 is an enlarged, fragmentary, partly-sectional plan view of the stops.

As is shown in FIG. 3, a number of stop carriers 43 are disposed pivotably on the gripper shaft 27 in such a way that they are spaced apart from one another. In this case, each stop 26 is assigned a stop carrier 43. The stop carriers 43 include an L-shaped lever which has an actuating device 44 at its end that faces away from the stop 26. The actuating device 44 pivots the carrier 43 and therefore the stop 26 by small angles about the gripper shaft 27. As a result of this measure, the stops 26 can be adjusted in the sheet transport direction independently of one another and, as a result, can be adapted exactly to the leading edge of the sheet.

The invention claimed is:

1. In a processing machine having a feed table and stops receiving sheets at a predefined speed at an end of the feed table, an apparatus for aligning the sheets on the stops, the apparatus comprising:

a cam mechanism including first and second control cams for producing a translational movement of the stops;

a common gripper shaft for said stops;

gear mechanism elements driven by said first control cam and disposed on said gripper shaft;

gear mechanism elements driven by said second control cam and disposed on said gripper shaft; and individually actuable actuating devices each assigned to a respective one of said stops.

2. The apparatus according to claim 1, wherein said control cams are configured to be driven by a gearwheel train of the sheet processing machine.

3. The apparatus according to claim 1, wherein said feed table defines a sheet transport plane, and said stops describe a movement path in a sheet transport direction lying above said sheet transport plane and describe a movement path counter to the sheet transport direction lying below said sheet transport plane.

4. The apparatus according to claim 1, which further comprises:

a feed cylinder having grippers with a speed;

said stops having a speed;

the sheet having a speed when coming into contact with said stops being greater than said speed of said stops; and said speed of said stops when transferring the sheet to said grippers of said feed cylinder being synchronized with said speed of said grippers of said feed cylinder.

5. The apparatus according to claim 1, wherein the processing machine is a printing press.

6. In a processing machine having a feed table and stops receiving sheets at a predefined speed at an end of the feed table, an apparatus for aligning the sheets on the stops, the apparatus comprising:

a cam mechanism including first and second control cams for producing a translational movement of the stops;

said control cams being configured to be driven by individually actuable motors.

7. The apparatus according to claim 6, wherein said control cams are configured to be driven by a gearwheel train of the sheet processing machine.

8. The apparatus according to claim 6, wherein said feed table defines a sheet transport plane, and said stops describe a movement path in a sheet transport direction lying above said sheet transport plane and describe a movement path counter to the sheet transport direction lying below said sheet transport plane.

9. The apparatus according to claim 6, which further comprises:

a feed cylinder having grippers with a speed;

said stops having a speed;

the sheet having a speed when coming into contact with said stops being greater than said speed of said stops; and said speed of said stops when transferring the sheet to said grippers of said feed cylinder being synchronized with said speed of said grippers of said feed cylinder.

10. The apparatus according to claim 6, wherein the processing machine is a printing press.

* * * * *